US011618601B2

(12) United States Patent
Li

(10) Patent No.: US 11,618,601 B2
(45) Date of Patent: Apr. 4, 2023

(54) VACUUM SEALING MACHINE CAPABLE OF LOCKING COVER AUTOMATICALLY HAVING UPPER COVER LIMITING MECHANISM

(71) Applicant: BONSEN ELECTRONICS LIMITED, Guangdong (CN)

(72) Inventor: Qincan Li, Guangdong (CN)

(73) Assignee: BONSEN ELECTRONICS LIMITED, Guangdong (CN)

( * ) Notice: Subject to any disclaimer, the term of this patent is extended or adjusted under 35 U.S.C. 154(b) by 54 days.

(21) Appl. No.: 17/262,813

(22) PCT Filed: Jan. 14, 2020

(86) PCT No.: PCT/CN2020/072006
§ 371 (c)(1),
(2) Date: Jan. 25, 2021

(87) PCT Pub. No.: WO2020/156146
PCT Pub. Date: Aug. 6, 2020

(65) Prior Publication Data

US 2021/0347508 A1 Nov. 11, 2021

(30) Foreign Application Priority Data

Feb. 1, 2019 (CN) ..... 201910105759.9

(51) Int. Cl.
*B65B 31/04* (2006.01)
*B65B 51/14* (2006.01)

(52) U.S. Cl.
CPC ..... *B65B 31/048* (2013.01); *B65B 51/148* (2013.01)

(58) Field of Classification Search
CPC ..... B65B 31/048; B65B 51/148; B65B 11/52; B65B 51/10
See application file for complete search history.

(56) References Cited

U.S. PATENT DOCUMENTS 3,979,877 A 9/1976 Vetter
6,256,968 B1 * 7/2001 Kristen ..... F04B 49/022 53/512

(Continued)

FOREIGN PATENT DOCUMENTS

CN 208165408 U 11/2018
CN 109677673 A 4/2019

(Continued)

*Primary Examiner* — Andrew M Tecco
*Assistant Examiner* — Nicholas E Igbokwe
(74) *Attorney, Agent, or Firm* — Alan D. Kamrath; Karin L. Williams; Mayer & Williams PC

(57) ABSTRACT

A vacuum sealing machine capable of locking cover automatically having upper cover limiting mechanism includes an upper lid, a lower seat, and an evacuation tank. The upper lid is hinged to the lower seat. The evacuation tank is located at the front of the vacuum sealing machine, and includes a lid-locking mechanism and an upper lid-limiting mechanism. The lid-locking mechanism is installed on the upper lid or the lower seat, and is connected to the upper lid-limiting mechanism. The upper lid-limiting mechanism includes a limiting lock plate and a limiting buckle portion. The limiting lock plate movably installed on the upper lid is fitted with the buckle of the limiting buckle portion installed on the lower seat; alternatively, the limiting lock plate movably installed on the lower seat is fitted with the buckle of the limiting buckle portion installed on the upper lid.

14 Claims, 11 Drawing Sheets

(56) References Cited

U.S. PATENT DOCUMENTS

| | | | | |
|---|---|---|---|---|
| 6,694,710 | B2 * | 2/2004 | Wang | B65B 31/06 53/88 |
| 7,204,067 | B2 * | 4/2007 | Baptista | B65B 31/046 53/512 |
| 9,352,864 | B2 * | 5/2016 | Hammad | B65B 31/024 |
| 2005/0022474 | A1 * | 2/2005 | Albritton | B29C 66/8324 53/512 |
| 2015/0232210 | A1 * | 8/2015 | Sung | B29C 66/849 307/26 |
| 2018/0370669 | A1 * | 12/2018 | Xu | B29C 65/02 |
| 2019/0047733 | A1 * | 2/2019 | Zheng | B65B 51/10 |

FOREIGN PATENT DOCUMENTS

| | | | |
|---|---|---|---|
| CN | 209650639 | U | 11/2019 |
| CN | 209939070 | U | 1/2020 |
| CN | 209939071 | U | 1/2020 |
| JP | S5393987 | A | 8/1978 |

* cited by examiner

VACUUM SEALING MACHINE CAPABLE OF LOCKING COVER AUTOMATICALLY HAVING UPPER COVER LIMITING MECHANISM

TECHNICAL FIELD

The present invention relates to the technical field of vacuum sealing machines, in particular to VACUUM SEALING MACHINE CAPABLE OF LOCKING COVER AUTOMATICALLY HAVING UPPER COVER LIMITING MECHANISM.

BACKGROUND ART

The upper lid of the existing vacuum sealing machine is hinged on the lower seat. When vacuum sealing is performed, the upper lid is rotated and opened first, and then the opening of the vacuum packaging bag is placed in an evacuation tank for fixation, then the upper lid is pressed tightly on the lower seat to lock the upper lid and the lower seat, and finally click the "Start" button of the vacuum sealing machine. The opening of the bag placed at the evacuation tank is often uneven, especially when there are many items packed in the vacuum packaging bag, the vacuum packaging bag is bulged, and the bag opening is stretched. When the upper lid is pressed against the lower seat, the bag opening may be skewed, wrinkled or uneven, which affects the effect of vacuuming and heat sealing. The user cannot press the upper lid while tightening the bag opening, which is inconvenient to use.

An upper sealing rubber ring is installed on the upper evacuation tank of the upper lid of the vacuum sealing machine, and a lower sealing rubber ring is installed on the lower evacuation tank of the lower seat. During vacuum sealing, the bag opening of the vacuum packaging bag needs to be inserted into the lower evacuation tank, the bag body of the vacuum packaging bag is pressed on the lower sealing rubber ring, and the evacuation requires that the lower sealing rubber ring is closely fitted with the upper sealing rubber ring. However, since the vacuum packaging bag has a certain thickness, the lower sealing rubber ring and the upper sealing rubber ring require an interference press fitting, the upper sealing rubber ring needs to protrude from the height set on the bottom surface of the upper lid, and the lower sealing rubber ring also needs to protrude from the height set on the top surface of the lower seat. Nevertheless, both the upper and lower sealing rubber rings are elastic materials, which are prone to deformation, which will cause the close contact surface of the upper and lower sealing rubber rings to deform and not seal, resulting in air leakage during evacuation and poor evacuation effect. Meanwhile, the sealing rubber ring is projected upward on the basis of the lower lid, and the bag opening placed on the protruding lower sealing rubber ring is prone to wrinkling, misalignment of the bag opening, and unevenness. When inserting a vacuum packaging bag, the lower sealing rubber ring will prevent the bag opening from being smoothly inserted into the lower evacuation tank, especially the vacuum packaging bag with the irregularly cut opening of the rolled bag.

During the work of the vacuum sealing machine, the vacuum sealing machine has a number of components that work asynchronously and require pressure to achieve its set action. Therefore, a plurality of valves or switches need to be installed in the vacuum sealing machine to respectively control the opening and closing of the pneumatic circuit of each component that works under pressure, which results in a complicated pipeline structure, easy leakage, and high production costs.

SUMMARY OF THE INVENTION

In view of the shortcomings of the prior art, the first objective of the present invention is to provide a VACUUM SEALING MACHINE CAPABLE OF LOCKING COVER AUTOMATICALLY HAVING UPPER COVER LIMITING MECHANISM to realize automatic lid locking and opening. The two hands only need to fix the vacuum packaging bag and click the "Start" button of the vacuum sealing machine to automatically complete the entire vacuum sealing, which is simple and convenient to use.

In view of the shortcomings of the prior art, the second objective of the present invention is to realize convenient placement of the vacuum packaging bag, small deformation of the sealing rubber ring, and good evacuation and heat sealing effects, simplify the internal pipeline structure, prevent air leakage and reduce production costs.

In order to achieve the above objectives, the technical solution adopted by the present invention is as follows: VACUUM SEALING MACHINE CAPABLE OF LOCKING COVER AUTOMATICALLY HAVING UPPER COVER LIMITING MECHANISM, comprising an upper lid, a lower seat, and an evacuation tank. The upper lid is hinged to the lower seat. The evacuation tank is located at the front of the vacuum sealing machine, comprising a lid-locking mechanism and an upper lid-limiting mechanism. The lid-locking mechanism is installed on the upper lid or the lower seat, and is connected to the upper lid-limiting mechanism. The upper lid-limiting mechanism comprises a limiting lock plate and a limiting buckle portion. The limiting lock plate movably installed on the upper lid is fitted with the buckle of the limiting buckle portion installed on the lower seat; alternatively, the limiting lock plate movably installed on the lower seat is fitted with the buckle of the limiting buckle portion installed on the upper lid. After the limiting lock plate is fitted with the buckle of the limiting buckle portion, a bag-in gap with a set height is set between the limiting lock plate and the limiting buckle portion to realize automatic lid locking and opening.

The Advantages of the Present Invention Over the Prior Art are:

1. Realize automatic lid locking and opening, easy to operate, prevent the bag opening from skewing, wrinkling, unevenness, etc., simple and convenient to use, and easily complete the entire vacuum packaging.

2. When the evacuation tank of the vacuum packaging bag needs to be cleaned, the upper lid can be selectively opened to a large extent for cleaning, which is easy to operate and meets the user's multiple choices.

3. The upper lid of the vacuum sealing machine of the present invention is provided with a flexible seal ring while the lower seat is provided with a smooth or flat bag-feeding platform, which is more convenient when placing or inserting a vacuum packaging bag. The bag is inserted smoothly, which effectively avoids the obstruction of bag placement and improves work efficiency. The bag-feeding platform can prevent the bag opening from wrinkling, misalignment or unevenness, with better evacuation and heat sealing effects.

4. The vacuum sealing machine of the present invention is provided with a flexible seal ring only on the upper lid, and no seal ring is provided on the lower seat, which will not block the insertion of the vacuum packaging bag, reduce the easily deformable sealing members, reduce the possibility of deformation of the elastic sealing members, and prolongs the service life of the vacuum sealing machine.

5. The vacuum sealing machine of the present invention communicates two sealed chambers at the same time through a gas valve device, so that two different sealed chambers can be kept independent of each other at the same time, or two different sealed chambers are connected to atmospheric pressure at the same time, reducing the number of valves used, simplifying the connection structure of the internal pipeline of the vacuum sealing machine, reducing the connection interfaces, and avoiding the occurrence of air leakage. The improved design of the gas valve device has a lower cost, which reduces the overall production cost.

THE FOLLOWINGS ARE MARKED IN THE FIGURES

Figure 1:
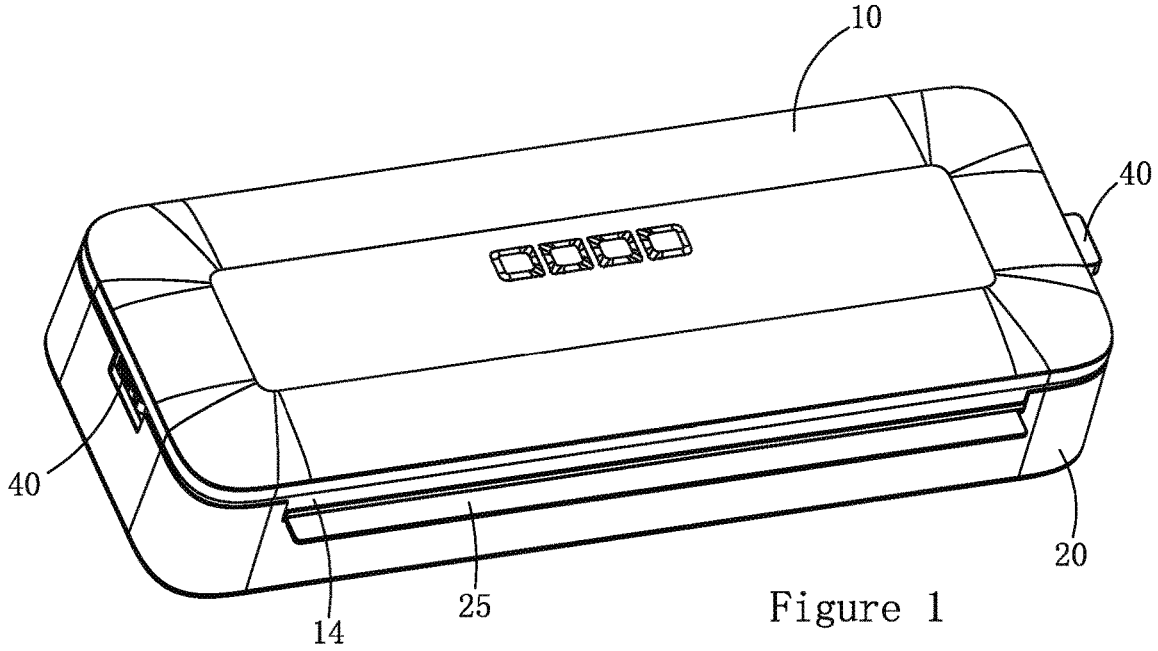
FIG. 1 is a structural schematic diagram of the present invention.

10—upper lid, 11—sliding slot, 12—upper evacuation tank, 13—flexible seal ring, 14—bag inlet, 18—push port;

20—lower seat, 22—lower evacuation tank, 23—baffle plate, 24—bag-feeding platform, 25—supporting portion;

31—concave chamber, 32—lifting plate, 34—elastic portion, 36—limiting buckle portion, 37—clamping portion, 38—separating portion; 40—limiting lock plate, 41—buckle through slot, 42—hand pressing portion;

50—pressure relief interface, 51—evacuation tank pressure relief chamber, 52—lid-locking pressure relief chamber, 53—evacuation tank connection port, 54—lid-locking connection port;

70—iron core, 71—sealing piece, 72—iron core driving device, 73—sealing hole portion, 74—pressure relief valve housing, 75—partition, 76—bracket, 77—iron core return spring, 78—bracket through hole.

DETAILED DESCRIPTION OF EMBODIMENTS

VACUUM SEALING MACHINE CAPABLE OF LOCKING COVER AUTOMATICALLY HAVING UPPER COVER LIMITING MECHANISM, as shown in FIG. 1 to FIG. 17, comprising an upper lid 10, a lower seat 20, and an evacuation tank. The upper lid 10 is hinged to the lower seat 20. The evacuation tank is located at the front of the vacuum sealing machine, comprising a lid-locking mechanism and an upper lid-limiting mechanism. The lid-locking mechanism is installed on the upper lid 10 or the lower seat 20, and is connected to the upper lid-limiting mechanism. The upper lid-limiting mechanism comprises a limiting lock plate 40 and a limiting buckle portion 36. The limiting lock plate 40 movably installed on the upper lid 10 is fitted with the buckle of the limiting buckle portion 36 installed on the lower seat 20; alternatively, the limiting lock plate 40 movably installed on the lower seat 20 is fitted with the buckle of the limiting buckle portion 36 installed on the upper lid 10. After the limiting lock plate 40 is fitted with the buckle of the limiting buckle portion 36, a bag-in gap with a set height is set between the limiting lock plate 40 and the limiting buckle portion 36.

Specifically, the upper lid 10 has an open position, a limited bag-in position and a locking position, when the upper lid 10 is in an open position, the limiting lock plate 40 is separated from the limiting buckle portion 36, and the upper lid 10 is in an open state with respect to the lower seat 20; when the upper lid 10 is in a limited bag-in position, the limiting lock plate 40 is fitted with the buckle of the limiting buckle portion 36, and the bag-in gap with a set height is maintained between the upper lid 10 and the lower seat 20 for inserting a vacuum packaging bag; and when the upper lid 10 is in a locking position, the upper lid 10 presses the lower seat 20. Preferably, the height of the front side of the bag-in gap is controlled at 1 to 5 mm, and the height of the middle and rear sides of the bag-in gap is controlled at 1 to 3 mm. The height of the opening on the front side of the bag-in gap is greater than the height of the back side gap, making the insertion of the vacuum packaging bag smoother and more convenient.

The hinged side of the upper lid 10 and the lower seat 20 is set as the rear side of the vacuum sealing machine, the side of the lower seat 20 provided with a lower evacuation tank 22 is set as the front side of the vacuum sealing machine, and the front side of the bag-in gap is consistent with the front side of the vacuum sealing machine.

When the existing vacuum sealing machine needs to perform vacuum packaging, the following operations are required: first, the vacuum packaging bag is fixed; then, the upper lid 10 and the lower seat 20 are closed and locked; finally, button operations such as programming of the vacuum sealing machine need to be performed, and the user cannot press the upper lid 10 while tightening the bag opening. In actual operation, the opening of the vacuum packaging bag placed at the evacuation tank often appears uneven; when the upper lid 10 presses the lower seat 20, the bag opening may be skewed, wrinkled or uneven, which affects the evacuation and heat sealing effects. The vacuum sealing machine of the present invention enables the upper lid 10 and the lower seat 20 to achieve limited locking by fitting the limiting lock plate 40 and the buckle of the limiting buckle portion 36. The upper lid 10 is in a limited bag-in position, the upper lid 10 and the lower seat 20 cannot be opened to a large extent, and a bag-in gap with a set height is left between the upper lid 10 and the lower seat 20, which is a state where the vacuum sealing machine has not started to work. After moving the vacuum packaging bag from the bag-in gap to the lower evacuation tank 22, the upper lid 10 and the lower seat 20 are locked by a lid-locking mechanism. The upper lid 10 is in a locked position, the upper lid 10 presses the lower seat 20, and the vacuum sealing machine starts evacuation. After the evacuation is completed, the heat sealing function is automatically enabled. After the heat sealing is completed, under the control of the control device, the evacuation tank communicates with the atmosphere, and at the same time, the lid-locking mechanism releases the locking of the upper lid 10 and the lower seat 20 to separate the upper lid 10 from the lower seat 20, so that the vacuum packaging bag can be easily pulled out to complete the evacuation and heat sealing of the entire vacuum packaging bag. Of course, the limiting buckle portion 36 can also be installed on the upper lid 10, and the limiting lock plate 40 is installed on the corresponding position of the lower seat 20, which can also achieve the same function. When the user needs to clean the evacuation tank of the vacuum sealing machine, simply move the buckle push plate left and right to release the buckle connection of the limiting buckle portion 36 on the limiting lock plate 40, and the limited locking can be easily released. The upper lid 10 and the lower seat 20 are largely opened, which is convenient for users to clean. The vacuum sealing machine of the present invention adds a limited bag-in position. When the upper lid 10 is in the limited bag-in position, the bag opening is inserted from the bag-in gap as the bag-in gap is relatively small. At this time, the state of the bag opening is close to the state of the bag opening when vacuuming. The bag opening has been preliminarily shaped to prevent the bag opening from wrinkling or moving, the bag opening is more flat, and the evacuation and heat sealing effects are better.

Specifically, a lid-locking mechanism comprises a lifting plate 32 and a driving device. The lifting plate 32 slides up and down on the top surface of the lower seat 20. The top surface of the lifting plate 32 is provided with the limiting buckle portion 36. The driving device is drivingly connected to the lifting plate 32. More specifically, a lid-locking mechanism comprises a concave chamber 31, the lower seat 20 is recessed downward to form a concave chamber 31, the position of the concave chamber 31 corresponds to the position of the lifting plate 32, the lifting plate 32 is connected to the concave chamber 31 to form a sealed chamber, an elastic portion 34 is provided in the sealed chamber, the elastic portion 34 abuts the top surface and the bottom surface of the sealed chamber, and the driving device is connected to the sealed chamber. The driving device is a suction device, preferably a suction pump. When the vacuum sealing machine is not activated, the elastic portion 34 abuts the top surface and bottom surface of the sealed chamber, and the elastic portion 34 may be a spring or an elastic sponge. When the driving device is activated, the driving device extracts air from the sealed chamber to make the sealed chamber into a negative pressure state, and compresses the elastic portion 34, so that the lifting plate 32 moves downward, and the lifting plate 32 further pulls the upper lid-limiting mechanism downward to lock the upper lid 10 and the lower seat 20. After the vacuum packaging bag is heat-sealed, when the upper lid 10 and the lower seat 20 need to be in a limited locking state (the limited locking state is the state when a bag-in gap with a set height is set between the limiting lock plate 40 and the limiting buckle portion 36 after the limiting lock plate 40 is fitted with the buckle of the limiting buckle portion 36), the sealed chamber is connected to the atmosphere to restore the sealed chamber to a normal atmospheric pressure state. The elastic portion 34 returns to the state before being compressed under the atmospheric pressure, thereby raising the lifting plate 32. The lifting plate 32 pushes the upper lid-limiting mechanism upward to separate the upper lid 10 from the lower seat 20, and the vacuum packaging bag can be easily pulled out.

There are many buckle structures that realize the locking and loosening of the lid-locking mechanism and the limiting lock plate 40, and the left and right movement of the limiting lock plate 40 or the back and forth movement of the limiting lock plate 40 can be realized. The movement of the limiting lock plate 40 may be a direct movement of the limiting lock plate 40, or the movement control of the limiting lock plate 40 may be achieved by a spin button through some transmission mechanisms. More specifically, the limiting lock plate 40 is slidably installed on the upper lid 10, and the limiting buckle portion 36 is fixedly installed on the lower seat 20; the middle of the upper lid 10 is provided with a sliding slot 11, the position of the sliding slot 11 corresponds to the position of the lid-locking mechanism, the limiting lock plate 40 is slidably installed in the sliding slot 11, the limiting buckle portion 36 is a buckle post with a set height installed in the lower seat 20, the middle of the limiting lock plate 40 is provided with a buckle through slot 41, and the buckle post is fitted with the buckle of the buckle through slot 41. At least one limiting buckle portion 36 and buckle through slot 41 are respectively provided, and there may be multiple. The buckle through slot 41 comprises a clamping portion 37 and a separating portion 38. When the clamping portion 37 moves to the limiting buckle portion 36, the limiting buckle portion 36 is fitted with the buckle of the limiting lock plate 40; when the separating portion 38 moves to the limiting buckle portion 36, the limiting buckle portion 36 is separated from the limiting lock plate 40. The limiting buckle portion 36 is provided with a set height, so that the bag-in gap between the upper lid 10 and the lower seat 20 is a movable and adjustable space in a limited locking state, i.e., the bag inlet 14 is movable and adjustable, and the vacuum packaging bag is more convenient to place.

Specifically, the buckle through slot 41 comprises a clamping portion 37 and a separating portion 38. When the clamping portion 37 moves to the buckle post, the limiting buckle portion 36 is fitted with the buckle of the limiting lock plate 40; when the separating portion 38 moves to the buckle post, the limiting buckle portion 36 is separated from the limiting lock plate 40. Each side of the upper lid 10 is provided with a push port 18, the left and right ends of the limiting lock plate 40 are respectively provided with a hand pressing portion 42, and at least one hand pressing portion 42 passes through the push port 18 and is exposed outside the upper lid 10. The limiting lock plate 40 is installed in the sliding slot 11, and the hand pressing portions 42 are all exposed on the side of the upper lid 10. When the limiting lock plate 40 and the limiting buckle portion 36 need to be locked, only the hand pressing portion 42 exposed on the side of the upper lid 10 needs to be moved to the other side of the vacuum sealing machine, the pushed hand pressing portion 42 moves towards the inner side of the vacuum sealing machine, and the hand pressing portion 42 on the other side is pushed and exposed on the other side of the vacuum sealing machine. When the upper lid 10 and the lower seat 20 need to be unlocked, it is only necessary to push the hand pressing portion 42 exposed on the other side back to a short distance in the opposite direction, so that the hand pressing portion 42 on the original side is exposed to the side of the vacuum sealing machine again, thereby releasing the locking of the limiting lock plate 40 and the limiting buckle portion 36.

The evacuation tank is recessed upward to form an upper evacuation tank 12, and recessed downward to form a lower evacuation tank 22, and the upper evacuation tank 12 corresponds to the position of the lower evacuation tank 22. A flexible seal ring 13 is installed on the outer periphery of the upper evacuation tank 12, and at least one baffle plate 23 protrudes upward from the rear inner edge of the lower evacuation tank 22. The baffle plate 23 is inserted into the upper evacuation tank 12 when the upper lid 10 and the lower seat 20 are closed. The flexible seal ring 13 is fitted with the lower evacuation tank 22 to form a sealed evacuation tank. The existing vacuum sealing machine is generally provided with a flexible seal ring 13 on the outer periphery of the evacuation tank of the upper lid 10 and the lower seat 20, respectively. For the vacuum sealing machine of the present invention, when the vacuum sealing machine is not activated, the upper lid 10 and the lower seat 20 are in a limited locking state, and the position of the bag inlet 14 is relatively small. When the bag opening of the vacuum packaging bag is pushed toward the lower evacuation tank 22 along the bag inlet 14, if the flexible seal ring 13 of the lower evacuation tank 22 protrudes upward, it will block the opening of the vacuum packaging bag, so that the vacuum packaging bag cannot smoothly enter the lower evacuation tank 22. Therefore, the flexible seal rings 13 of the present invention are all disposed on the outer periphery of the upper evacuation tank 12, and the portion from the bag inlet 14 to the lower evacuation tank 22 forms a flat plane, so that the opening of the vacuum packaging bag can smoothly enter the lower evacuation tank 22. A baffle 23 is provided in the vacuum sealing machine to ensure that the opening of the vacuum packaging bag can stay in the lower evacuation tank 22 to prevent the vacuum packaging bag from being excessively moved in and thus the evacuation cannot be normally performed.

The front end of the lower seat 20 is provided with a bag inlet 14. Both ends of the bag inlet 14 extend to both sides of the lower seat 20. A bag-feeding platform 24 is provided at the bottom of the bag inlet 14, and the bag-feeding platform 24 extends from the front side of the lower seat 20 to the lower evacuation tank 22. A bag-feeding platform 24 is provided on the lower seat 20, so that the vacuum packaging bag has a larger supporting space, and the placement of the vacuum packaging bag is more stable.

The upper lid 10 is installed with an automatic plate pushing mechanism, and when the upper lid 10 rotates toward the lower seat 20 and reaches the limited bag-in position, the automatic plate pushing mechanism pushes the limiting lock plate 40, and the limiting lock plate 40 is fitted with the buckle of the limiting buckle portion 36; and the automatic plate pushing mechanism uses a mechanical transmission mechanism driven by a spring, an electromagnet or a motor. The operation of the vacuum sealing machine is further automated. Under the control of the vacuum sealing machine's control device, the installation program is set to control the vacuum sealing machine to automatically operate the limiting lock plate 40 to fit with the buckle of the limiting buckle portion to realize the automatic buckling and automatic separation of the upper lid-limiting mechanism, which makes the operation easier.

A heat-sealing portion is provided between the bag-feeding platform 24 and the lower evacuation tank 22, and an adhesive strip is provided on the upper lid 10 opposite the heat-sealing portion. The heat-sealing portion can use heating wires, and heat-seals the vacuum packaging bag. After the upper lid 10 and the lower seat 20 are vacuum-locked, the adhesive strip compresses the vacuum packaging bag to prevent the vacuum packaging bag from being displaced. An evacuation pump is provided in the lower seat 20, and the evacuation pump is connected to the lower evacuation tank 22. The evacuation pump performs an evacuation operation on the evacuation tank, and the lower evacuation tank 22 is also provided with a pressure relief valve, and communicates with the atmosphere through the pressure relief valve, so that the negative pressure evacuation tank is restored to the atmospheric pressure state. The upper lid 10 is provided with a control device, and the control device is electrically connected to a driving device and an evacuation pump. The control device realizes the control of the driving device and the evacuation pump by controlling the circuit, so as to complete the evacuation and heat sealing of the vacuum sealing machine.

As shown in FIG. 1 to FIG. 6, it comprises an upper lid 10, a lower seat 20 and a vacuum pumping device. The upper lid 10 is hinged to the lower seat 20, the lower seat 20 is provided with a lower evacuation tank 22, the vacuum pumping device is connected to the lower evacuation tank 22, the lower seat 20 is provided with a bag-feeding platform 24, the bag-feeding platform 24 extends from the lower evacuation tank 22 to the front end of the lower seat 20, a flexible seal ring 13 is installed on the bottom surface of the upper lid 10, the flexible seal ring 13 protrudes from the bottom surface of the upper lid 10, the flexible seal ring 13 presses the bag-feeding platform 24 of the lower seat 20 when the upper lid 10 is locked with the lower seat 20, and the flexible seal ring 13 surrounds and encloses the lower evacuation tank 22. Specifically, the flexible seal ring 13 has an upper fixing portion and an annular wall body. The upper fixing portion is installed on the bottom surface of the upper lid 10, the annular wall body is installed on the upper fixing portion, and the annular wall body projects downward from the upper lid 10.

The hinged side of the upper lid 10 and the lower seat 20 is set as the rear side of the vacuum sealing machine, the side of the lower seat 20 provided with a lower evacuation tank 22 is set as the front side of the vacuum sealing machine, and the front side of the bag-in gap is consistent with the front side of the vacuum sealing machine.

The lower seat 20 of the existing vacuum sealing machine is provided with a lower sealing rubber ring, and the upper lid 10 is provided with an upper sealing rubber ring. The upper sealing rubber ring and the lower sealing rubber ring are pressed tightly, so that the evacuation tank forms a sealed vacuum chamber. Both the upper sealing rubber ring and the lower sealing rubber ring are formed of an elastic substance, and the elastic substance is liable to deform after repeated use. Therefore, after long-term use, both the upper sealing rubber ring and the lower sealing rubber ring are prone to deformation, the contact surfaces of the upper sealing rubber ring and the lower sealing rubber ring are uneven, and the evacuation tank leaks air during evacuation, resulting in a poor evacuation effect. When replacing parts, the upper sealing rubber ring and the lower sealing rubber ring must be replaced at the same time, the service life of the parts is short, and the use cost is high. The lower sealing rubber ring is projected upwards on the basis of the lower seat 20. When it is placed in a vacuum packaging bag with curling degree, it is prone to jamming, which is inconvenient to operate, reduces work efficiency, and easily leads to misalignment, wrinkling or unevenness of the bag opening, and thus affect the evacuation and heat sealing effects. The vacuum sealing machine of the present invention is provided with a bag-feeding platform 24 on the lower seat 20, and a flexible seal ring 13 provided on the upper lid 10. The flexible seal ring 13 is made of an elastic substance, and may be a plastic sponge, etc., and is preferably silicone. The bag-feeding platform 24 is a flat platform. The bag opening enters from the bag-feeding platform 24 at the front end of the lower seat 20, and moves all the way to the lower evacuation tank 22, without being blocked by the lower sealing rubber ring. The bag opening is placed smoothly without jamming, and is easy to operate. Meanwhile, the bag opening is placed flat without wrinkling, and the evacuation and heat sealing effects are good. When the upper lid 10 and the lower seat 20 are locked, the flexible seal ring 13 and the lower seat 20 are pressed tightly, so that a sealed evacuation tank is formed in the lower evacuation tank 22. The flexible seal ring 13 of the upper lid 10 is directly attached to the upper surface of the lower lid to form a closed space, which eliminates the use of the flexible seal ring 13 of the lower seat 20, reduces the use of the elastic portion 34, reduces the probability of deformation of the elastic portion 34, and extends the service life of the vacuum sealing machine. If the flexible seal ring 13 is deformed after long-term use, it is only necessary to replace the flexible seal ring 13 of the upper lid 10, and it is not necessary to replace the upper sealing rubber ring and the lower sealing rubber ring at the same time, reducing replacement parts and saving energy.

Preferably, the lower evacuation tank 22 is provided with an upper evacuation tank 12 at a position corresponding to the upper lid 10, at least one baffle plate 23 protrudes upward from the rear edge of the lower evacuation tank 22, and the baffle plate 23 is inserted into the upper evacuation tank 12 when the upper lid 10 and the lower seat 20 are closed. A baffle 23 is provided in the vacuum sealing machine, and the opening of the vacuum packaging bag can be ensured to stay within the range of the lower evacuation tank 22 to prevent the bag opening from being excessively moved in and thus the evacuation cannot be normally performed.

Specifically, the front end of the lower seat 20 is provided with a bag inlet 14, the position of the bag inlet 14 is adapted to the bag-feeding platform 24, and the bag inlet 14 is located at the upper part of the bag-feeding platform 24. Preferably, the bag inlet 14 is set to a certain height, and a larger placement inlet is provided when the vacuum packaging bag is placed, which facilitates the entrance of the bag opening and the operation.

The bag-feeding platform 24 extends outward from the front end of the lower seat 20 to project outward to form a supporting portion 25. The supporting portion 25 is further extended on the basis of the bag-feeding platform 24. The opening section of the vacuum packaging bag has a certain support, so that the bag opening is not wrinkled and more flat during placement.

A vacuum sealing machine comprises an upper lid-limiting mechanism. The upper lid-limiting mechanism comprises a limiting lock plate 40 and a limiting buckle portion 36. The limiting lock plate 40 movably installed on the upper lid 10 is fitted with the buckle of the limiting buckle portion 36 installed on the lower seat 20; alternatively, the limiting lock plate 40 movably installed on the lower seat 20 is fitted with the buckle of the limiting buckle portion 36 installed on the upper lid 10; the upper lid 10 has an open position, a limited bag-in position and a locking position, when the upper lid 10 is in an open position, the limiting lock plate 40 is separated from the limiting buckle portion 36, the upper lid 10 is in an open state with respect to the lower seat 20, and the flexible seal ring 13 is away from the lower seat 20; when the upper lid 10 is in a limited bag-in position, the bag-in gap with a set height is maintained between the upper lid 10 and the lower seat 20 for inserting a vacuum packaging bag, the limiting lock plate 40 is fitted with the buckle of the limiting buckle portion 36, and the flexible seal ring 13 is separated from the lower seat 20; and when the upper lid 10 is in a locking position, the flexible seal ring 13 abuts the lower seat 20, and the upper lid 10 presses the lower seat 20. Enable the upper lid 10 and the lower seat 20 to achieve limited locking by fitting the limiting lock plate 40 and the buckle of the limiting buckle portion 36. The upper lid 10 is in a limited bag-in position, the upper lid 10 and the lower seat 20 cannot be largely opened, and a bag-in gap with a set height is left between the upper lid 10 and the lower seat 20, which is a state where the vacuum sealing machine has not started to work. After moving the vacuum packaging bag from the bag-in gap to the lower evacuation tank 22, the upper lid 10 and the lower seat 20 are locked by a lid-locking mechanism. The upper lid 10 is in a locked position, the upper lid 10 presses the lower seat 20, and the vacuum sealing machine starts evacuation. After the evacuation is completed, the heat sealing function is automatically enabled. After the heat sealing is completed, under the control of the control device, the evacuation tank communicates with the atmosphere, and at the same time, the lid-locking mechanism releases the locking of the upper lid 10 and the lower seat 20 to separate the upper lid 10 from the lower seat 20, so that the vacuum packaging bag can be easily pulled out to complete the evacuation and heat sealing of the entire vacuum packaging bag. Of course, the limiting buckle portion 36 can also be installed on the upper lid 10, and the limiting lock plate 40 is installed on the corresponding position of the lower seat 20, which can also achieve the same function. When the user needs to clean the evacuation tank of the vacuum sealing machine, simply move the buckle push plate left and right to release the buckle connection of the limiting buckle portion 36 on the limiting lock plate 40, and the limited locking can be easily released. The upper lid 10 and the lower seat 20 are largely opened, which is convenient for users to clean. The vacuum sealing machine of the present invention adds a limited bag-in position. When the upper lid 10 is in the limited bag-in position, the bag opening is inserted from the bag-in gap as the bag-in gap is relatively small. At this time, the state of the bag opening is close to the state of the bag opening when vacuuming. The bag opening has been preliminarily shaped to prevent the bag opening from wrinkling or moving, the bag opening is more flat, and the evacuation and heat sealing effects are better.

Preferably, the limiting lock plate 40 is slidably installed on the upper lid 10, and the limiting buckle portion 36 is fixedly installed on the lower seat 20; the middle of the upper lid 10 is provided with a sliding slot 11, the limiting lock plate 40 is slidably installed in the sliding slot 11, the limiting buckle portion 36 is a buckle post with a set height installed in the lower seat 20, the middle of the limiting lock plate 40 is provided with a buckle through slot 41, and the buckle post is fitted with the buckle of the buckle through slot 41. When the upper lid 10 is kept in a limited bag-in position or the upper lid 10 is restored to an open position, it is only necessary to slide the limiting lock plate 40 or the limiting buckle portion 36 left and right. When the limiting lock plate 40 or the limiting buckle portion 36 is pushed in a forward direction, the limiting lock plate 40 is fitted with the limiting buckle portion 36; when the limiting lock plate 40 or the limiting buckle portion 36 is pushed in a backward direction, the limiting lock plate 40 releases the buckle fitting with the limiting buckle portion 36, and the upper lid 10 is separated from the lower seat 20.

The lower seat 20 is provided with a lid-locking mechanism, comprising a lifting plate 32 and a driving device. The lifting plate 32 slides up and down on the top surface of the lower seat 20. The top surface of the lifting plate 32 is provided with the limiting buckle portion 36. The driving device is drivingly connected to the lifting plate 32. Specifically, a lid-locking mechanism comprises a concave chamber 31, the lower seat 20 is recessed downward to form a concave chamber 31, the position of the concave chamber 31 corresponds to the position of the lifting plate 32, the lifting plate 32 is connected to the concave chamber 31 to form a sealed chamber (i.e., a lid-locking chamber), an elastic portion 34 is provided in the sealed chamber, the elastic portion 34 abuts the top surface and the bottom surface of the sealed chamber, and the driving device is connected to the sealed chamber. The buckle post is installed on the upper surface of the lifting plate 32, and the buckle post is fitted with the buckle of the buckle through slot 41. The driving device is a suction device, preferably a suction pump. When the vacuum sealing machine is not activated, the elastic portion 34 abuts the top surface and bottom surface of the sealed chamber, and the elastic portion 34 may be a spring or an elastic sponge. When the driving device is activated, the driving device extracts air from the sealed chamber to make the sealed chamber into a negative pressure state, and compresses the elastic portion 34, so that the lifting plate 32 moves downward and thus pulls the limiting lock plate 40 downward to lock the upper lid 10 and the lower seat 20. After the vacuum packaging bag is heat-sealed, when the upper lid 10 and the lower seat 20 need to be loosened, the sealed chamber is connected to the atmosphere to restore the sealed chamber to a normal atmospheric pressure state. The elastic portion 34 returns to the state before being compressed under the atmospheric pressure, thereby raising the lifting plate 32. The lifting plate 32 pushes the upper lid 10 upward to separate the upper lid 10 from the lower seat 20, and the vacuum packaging bag can be easily pulled out.

As shown in FIG. 1 to FIG. 17, it comprises a vacuum pumping device and at least two vacuum working chambers. The vacuum pumping device is connected to each vacuum working chamber, respectively. The vacuum sealing machine comprises an air valve device, comprising a solenoid and a pressure relief valve housing 74. The solenoid is provided with a bracket 76 and an iron core 70, and the iron core 70 is slidably installed on the bracket 76; the pressure relief valve housing 74 is installed on the bracket 76, at least two pressure relief interfaces 50 are provided on the first side of the pressure relief valve housing 74, and the sealing hole portion 73 is provided on the second side; at least one partition 75 is installed in the inner chamber of the pressure relief valve housing 74, the inner chamber of the pressure relief valve housing 74 is partitioned by the partition 75 to form at least two pressure relief chambers, each of which is connected to the inner end of a corresponding pressure relief interface 50, respectively; a first end portion of the iron core 70 faces the sealing hole portion 73, a sealing piece 71 is fixed at the first end portion of the iron core 70, and the sealing piece 71 is sealingly fitted with the sealing hole portion 73; and the outer end of each pressure relief interface 50 communicates with a corresponding vacuum working chamber, respectively.

The existing vacuum sealing machine needs to evacuate or inflate a plurality of vacuum working chambers during work, pressurize the vacuum working chambers, or make the vacuum working chambers become negative pressure. The change in atmospheric pressure in the vacuum working chamber realizes the setting action of its connecting parts, and completes the functions such as evacuation or lid locking. After completing the functions such as evacuation or lid locking, the vacuum working chamber under pressure or negative pressure needs to be restored to the atmospheric pressure state. Since the setting action of the connected parts of each vacuum working chamber is required to be performed asynchronously, the existing vacuum sealing machine can only control the intake or exhaust of the vacuum working chamber by installing a plurality of solenoid valves, respectively, so as to achieve the setting action of each part asynchronously according to the setting requirements. A plurality of parts are connected to the solenoid valves through pipelines. The large number of solenoid valves, the large number of interfaces between the solenoid valves and the pipelines, and the large number of connected pipelines result in complicated pipeline connection structures. A large number of interfaces can easily cause air leakage, and a large number of solenoid valves leads to high production costs. The vacuum sealing machine of the present invention separates a pressure relief chamber from the atmospheric pressure only through an air valve device and a sealing piece 71, and a partition 75 separates the pressure relief chamber into a plurality of independent pressure relief chambers. Each independent chamber is respectively connected to a corresponding vacuum working chamber. For this purpose, the air valve device can be connected to a plurality of vacuum working chambers at the same time, so that the on-off of the air pressure circuit in the vacuum working chamber can be controlled at the same time. The pipeline connection structure is simple, reducing the possibility of air leakage and reducing production costs.

Of course, the three-position three-way solenoid valve or the four-position three-way solenoid valve in the prior art can achieve the same function. However, at the current market price, the procurement cost of the existing three-position three-way solenoid valve or four-position three-way solenoid valve needs at least 50 yuan. The air valve device of the present invention is a valve body structure specially designed on the basis of a small solenoid valve, and its procurement cost only needs 1 to 3 yuan, while simplifying the gas circuit connection structure, and greatly reducing the production cost of the vacuum sealing machine.

Specifically, when the sealing piece 71 is in the closed position, the sealing piece 71 is sealingly fitted with the sealing hole portion 73, and each pressure relief chamber is connected with the corresponding vacuum working chamber to form each sealed vacuum working chamber; at this time, each sealed vacuum working chamber is a sealed environment, and preparations are made for exhausting or inflating in the sealed vacuum working chamber; and the vacuum pumping device corresponding to each sealed vacuum working chamber evacuates or inflates the sequence set by the installation program of the sealed vacuum working chamber. When the sealing piece 71 is in the chamber communication position, the sealing piece 71 is separated from the sealing hole portion 73, the sealing hole portion 73 is connected to the atmospheric pressure, and each pressure relief chamber and the corresponding vacuum working chamber are connected to the atmospheric pressure. When the sealing piece 71 is separated from the sealing hole portion 73, each of the sealed vacuum working chambers is connected to the atmospheric pressure at the same time, so that the sealed vacuum working chambers are simultaneously relieved of pressure.

Specifically, the air valve device is structured to comprise a solenoid. The solenoid is provided with a bracket 76 and an iron core 70, and the iron core 70 is installed on the bracket 76. The air valve device comprises at least one pressure relief valve housing 74. The pressure relief valve housing 74 is installed on the bracket 76. The pressure relief valve housing 74 is provided with at least one pressure relief chamber and at least one pressure relief interface 50, and each pressure relief interface 50 communicates with a corresponding pressure relief chamber. A first end portion of the iron core 70 faces the pressure relief valve housing 74, and at least one sealing portion is fixed to the first end portion of the iron core 70. After the iron core 70 moves toward the pressure relief valve housing 74, the sealing portions are sealingly fitted with the pressure relief chambers, respectively.

The air valve device of the present invention divides the inner chamber of the pressure relief valve housing 74 into a plurality of independent pressure relief chambers through a partition 75; alternatively, a plurality of pressure relief valve housings 74 are installed on the bracket 76, and at least one pressure relief chamber is provided in the pressure relief valve housing 74, so that each pressure relief chamber is connected to its corresponding pipeline. When the sealing piece 71 and the sealing hole portion 73 are sealingly fitted in the corresponding pipeline, each pipeline remains independent from each other, the amount of medium in each pipeline does not affect each other, and the amount of medium in a certain pipeline can be controlled independently. For example, evacuate or inflate a certain pipeline individually to change the amount of medium in a certain pipeline; alternatively, according to the requirements set by the equipment program, there is a sequence requirement for the change in the amount of medium in each pipeline, and the amount of medium in each pipeline is changed individually and sequentially according to the program setting.

Specifically, at least two pressure relief interfaces 50 are provided on the first side of the pressure relief valve housing 74, and the sealing hole portion 73 is provided on the second side; at least one partition 75 is integrally formed in the inner chamber of the pressure relief valve housing 74, the inner chamber of the pressure relief valve housing 74 is partitioned by the partition 75 to form at least two pressure relief chambers, the first side of each pressure relief chamber communicates with the inner end of a corresponding pressure relief interface 50, and the second side communicates with the sealing hole portion 73, respectively; a first end portion of the iron core 70 faces the sealing hole portion 73; the sealing portion comprises at least one sealing piece 71 fixed to the first end portion of the iron core 70; when the sealing portion moves toward the pressure relief valve housing 74 and the sealing portion abuts against the sealing hole portion 73 or the bracket 76, the sealing piece 71 is sealingly fitted with the sealing hole portion 73, and the sealing piece 71 respectively seals each pressure relief chamber. The same pressure relief chamber may be provided with a plurality of pressure relief interfaces 50. The pressure relief interfaces 50 in the same pressure relief chamber can only be connected to pipelines that are closed or opened at the same time, and connected to pipelines that can only change the amount of the medium at the same time.

The sealing piece 71 has a closed position and a chamber communication position. When the sealing piece 71 is in the closed position, the sealing piece 71 is sealingly fitted with the sealing hole portion 73, each pressure relief chamber forms a separately sealed independent chamber, and the sealing piece 71 is sealingly fitted with each pressure relief chamber, respectively; when the sealing piece 71 is in the chamber communication position, the sealing piece 71 is separated from the sealing hole portion 73, the sealing hole portion 73 is connected to the atmospheric pressure, and each pressure relief chamber is connected to the atmospheric pressure, respectively. The sealing piece 71 has a closed position and a chamber communication position. More specifically, the sealing position is located between the top surface and the bottom surface of the sealing hole portion 73, and the chamber communication position is located inside the bracket 76. When the sealing piece 71 is in the closed position, the sealing piece 71 is sealingly fitted with the sealing hole portion 73, and each pressure relief chamber is connected with the corresponding vacuum working chamber to form each sealed vacuum working chamber; at this time, each sealed vacuum working chamber is a sealed environment, and preparations are made for exhausting or inflating in the sealed vacuum working chamber; and the vacuum pumping device corresponding to each sealed vacuum working chamber evacuates or inflates the sequence set by the installation program of the sealed vacuum working chamber. When the sealing piece 71 is in the chamber communication position, the sealing piece 71 is separated from the sealing hole portion 73, the sealing hole portion 73 is connected to the atmospheric pressure, and each pressure relief chamber and the corresponding vacuum working chamber are connected to the atmospheric pressure. When the sealing piece 71 is separated from the sealing hole portion 73, each of the sealed vacuum working chambers is connected to the atmospheric pressure at the same time, so that the sealed vacuum working chambers are simultaneously relieved of pressure.

The outside shape of the sealing piece 71 matches the shape of the inner wall of the sealing hole portion 73, and the outside of the sealing piece 71 abuts against the inner wall of the sealing hole portion 73. Specifically, the structure of the air valve device is such that the outside shape of the sealing piece 71 matches the shape of the inner wall of the sealing hole portion 73, and the outside of the sealing piece 71 abuts against the inner wall of the sealing hole portion 73. In a more preferred embodiment, a sealing rubber ring is sleeved on the outer side of the sealing piece 71 so that the outer edge of the sealing rubber ring and the inner wall of the sealing hole portion 73 are in interference fit, so as to enhance the sealability between the sealing rubber ring and the inner wall of the sealing hole portion 73, and further prevent air leakage.

The solenoid comprises an iron core return spring 77, the iron core return spring 77 is sleeved on the iron core 70, one end of the iron core return spring 77 is connected to the iron core 70, and the other end abuts against or is connected to the bracket 76. When the sealing piece 71 is sealingly fitted with the sealing hole portion 73, a resetting device elastically drives the sealing piece 71 away from the sealing hole portion 73 to restore the sealing piece 71 to the chamber communication position. The iron core driving device is preferably an electromagnetic driving device. The electromagnetic driving device drives the iron core 70 to slide. One end of the iron core 70 is connected to the sealing piece 71, so that the sealing piece 71 slides back and forth between the sealing position and the chamber communication position. More specifically, the solenoid comprises an iron core driving device 72, the iron core driving device 72 is located inside or outside the bracket 76, the iron core driving device 72 comprises at least one winding group, the winding group is fixed to the middle and rear part of the iron core 70, and the winding group is wrapped around the outer edge of the middle and rear part of the iron core 70; after the winding group is energized, the iron core 70 is driven to move the sealing piece 71 to the closed position; after the winding group is powered off, under the action of the iron core return spring 77, the iron core 70 drives the sealing piece 71 to move to the chamber communication position.

Specifically, the rear end portion of the pressure relief valve housing 74 is fixed to the front end portion of the bracket 76, the front end surface of the pressure relief valve housing 74 is a closed surface, each of the pressure relief interfaces 50 is respectively provided on a side of the pressure relief valve housing 74, and the rear end surface of the pressure relief valve housing 74 is provided with the sealing hole portion 73. More specifically, the front end of the bracket 76 is provided with a front panel, the middle of the front panel is provided with a bracket through hole 78, and the rear end portion of the pressure relief valve housing 74 is fixed to the bracket 76; and the sealing hole portion 73 communicates with the bracket through hole 78, and the sealing piece 71 is sealingly fitted with the bracket through hole 78 or the sealing piece 71 is sealingly fitted with the sealing hole portion 73. Preferably, the partition 75 divides the inner chamber of the pressure relief valve housing 74 into a plurality of pressure relief chambers, and the top surface of the sealing piece 71 abuts against the bottom surface of the partition 75 through the sealing hole portion 73, so as to seal the pressure relief chambers.

In the air valve device, there are various methods for setting the pressure relief valve housing, including the following two methods but not limited to the following methods. Method 1: As shown in FIG. 14 to FIG. 17, a plurality of pressure relief valve housings 74 can be installed on the bracket, and each pressure relief valve housing 74 has at least one pressure relief chamber inside; alternatively, Method 2: As shown in FIG. 2 to FIG. 7, a pressure relief valve housing 74 is installed on the bracket, the inner chamber of the pressure relief valve housing 74 is divided into a plurality of pressure relief chambers by a partition 75 in the pressure relief valve housing 74, each pressure relief chamber is provided with at least one pressure relief interface 50, and one side of each pressure relief chamber is connected to the sealing hole portion 73. The outer shape of the sealing piece 71 matches the shape of the inner wall of the sealing hole portion 73. When the sealing piece 71 is sealingly fitted with the sealing hole portion 73, the sealing piece 71 abuts against the sealing hole portion 73.

Figure 14:
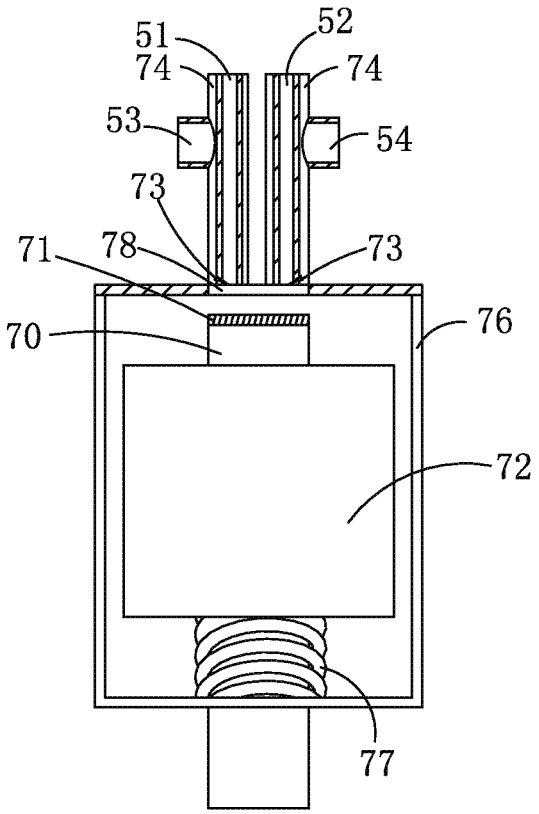
FIG. 14 is a structural schematic diagram of a local section of an air valve device when the rear end surfaces of two pressure relief valve housings are fixed together and then installed on a front side of a front panel and a sealing piece is located at a chamber communication position of the present invention.
Figure 15:
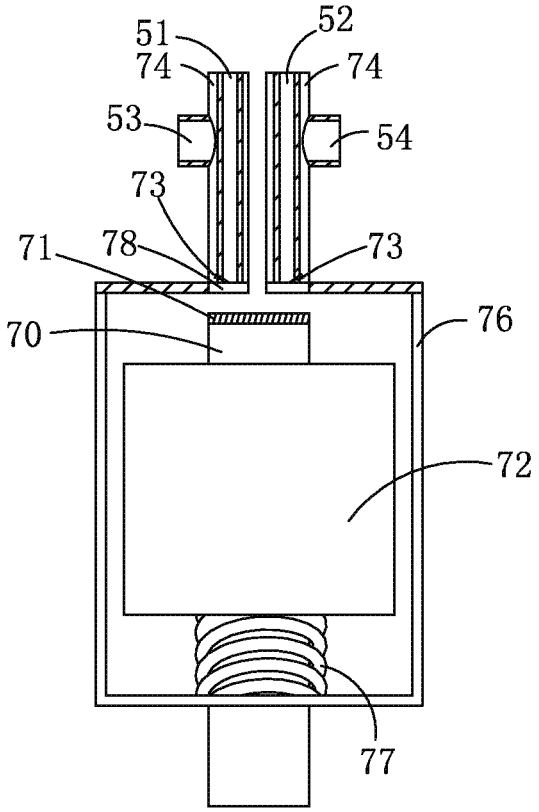
FIG. 15 is a structural schematic diagram of a local section of an air valve device when the rear end surfaces of two pressure relief valve housings are respectively installed on a front side of a front panel and a sealing piece is located at a chamber communication position of the present invention.
Figure 16:
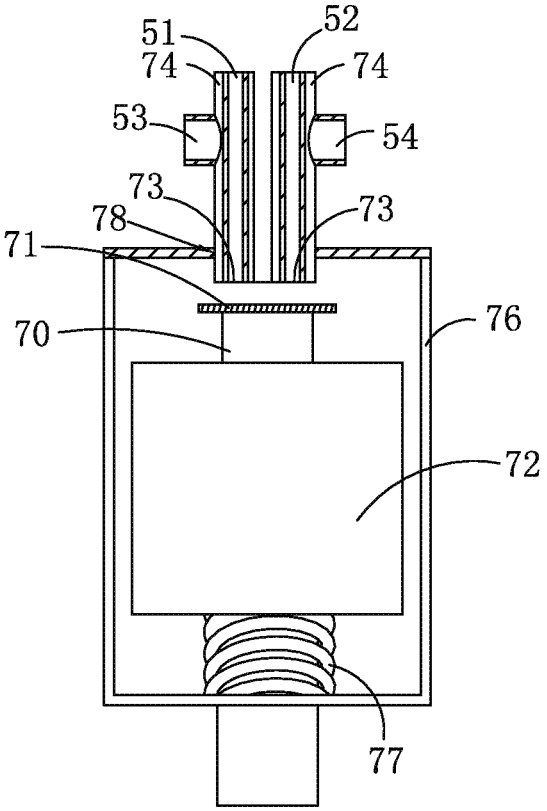
FIG. 16 is a structural schematic diagram of a local section of an air valve device when the rear end surfaces of two pressure relief valve housings are fixed and then protruded and installed on a rear side of a front panel and a sealing piece is located at a chamber communication position of the present invention.
Figure 17:
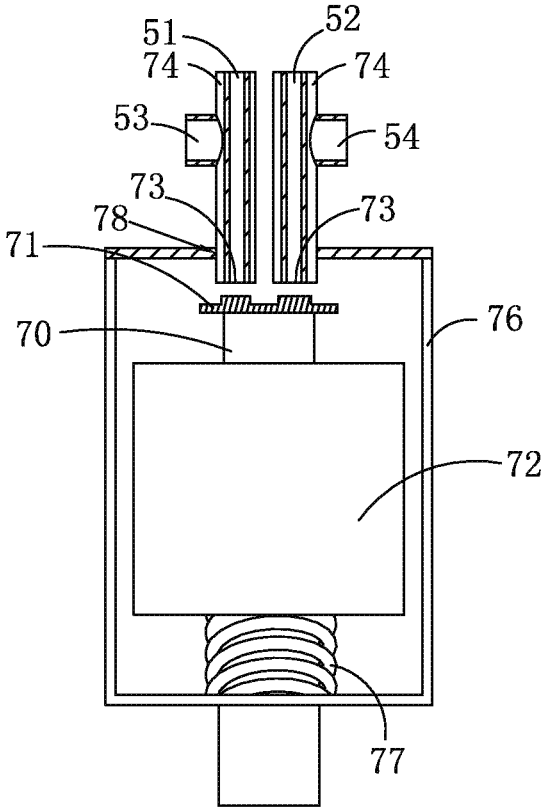
FIG. 17 is a structural schematic diagram of a local section of an air valve device when the rear end surfaces of two pressure relief valve housings are respectively installed on a rear side of a front panel, the sealing pieces are respectively sealingly fitted with the sealing hole portions, and a sealing piece is located at a chamber communication position of the present invention.

The first setting method of the pressure relief valve housing 74 is specifically, at least two pressure relief valve housings 74 are installed at the front end of the through hole 78 of the bracket 76, a pressure relief chamber is formed in each pressure relief valve housing 74; alternatively, each pressure relief valve housing 74 is provided with a plurality of pressure relief chambers through a partition 75, each pressure relief chamber is provided with at least one pressure relief interface 50, and one side of each pressure relief chamber is connected to the sealing hole portion 73. More specifically, as shown in FIG. 14 to FIG. 15, two pressure relief valve housings 74 are respectively installed at the front end of the bracket 76, the rear ends of the sealing hole portions 73 in the two pressure relief valve housings 74 are respectively installed at the front end of the through hole 78 of the bracket 76, and the sealing piece 71 is sealingly fitted with the pressure relief chambers of two pressure relief valve housings 74, respectively; specifically, the upper end of the sealing piece 71 facing the sealing hole portion 73 is sealingly fitted with the sealing hole portions 73 of the two pressure relief valve housings 74, respectively. Among which, as shown in FIG. 14, two pressure relief valve housings 74 are fixedly installed together and then installed on a bracket 76; as shown in FIG. 15, two pressure relief valve housings 74 are respectively installed on the bracket 76; alternatively, two pressure relief valve housings 74 are respectively installed on the bracket 76, and the outer contours of the sealing pieces 71 are respectively matched with the shape of the inner chamber of each pressure relief valve housing 74; alternatively, the side where the pressure relief chamber is connected to the sealing hole portion 73 is a connection side, the outer shape of the sealing piece 71 matches the shape of the connection side, respectively, and the sealing piece 71 is sealingly fitted with each of the pressure relief chambers, respectively. As shown in FIG. 16 to FIG. 17, two pressure relief valve housings 74 are respectively protruded and installed on the rear side of the front panel, the sealing piece 71 faces the upper end surface of the sealing hole portion 73 and abuts the rear end surface of each pressure relief valve housing 74, the upper end surface of the sealing piece 71 is sealingly fitted with each pressure relief chamber, and the cross section of the sealing piece 71 is larger than that of the bracket through hole 78. As shown in FIG. 17, the outer contour of the sealing piece 71 is adapted to the shape of the inner wall of the sealing hole portion 73, respectively, and the sealing piece 71 is sealingly fitted with each pressure relief chamber.

Figure 2:
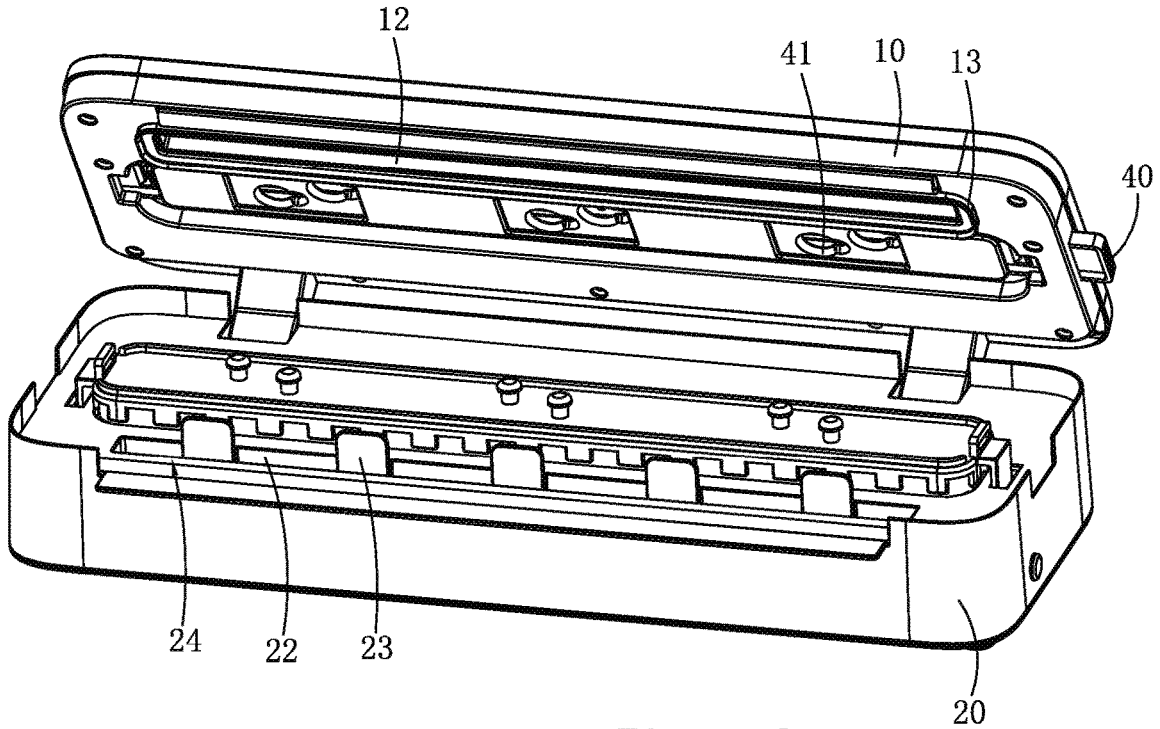
FIG. 2 is a structural schematic diagram when the upper lid is largely opened of the present invention.
Figure 3:
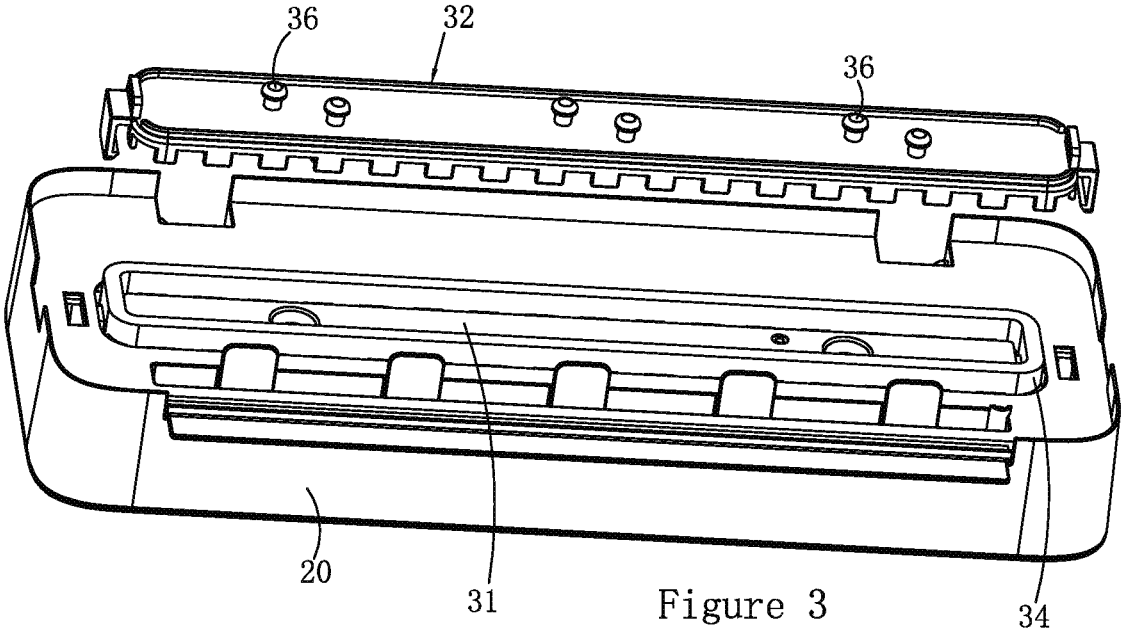
FIG. 3 is a structural schematic diagram of a lower seat component of the present invention.
Figure 4:
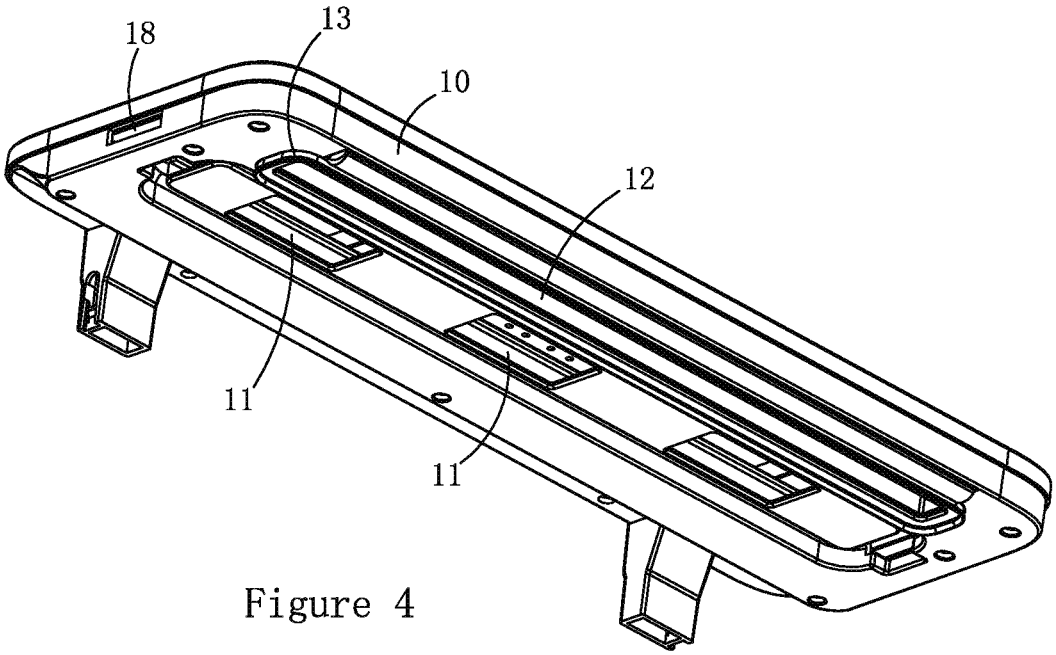
FIG. 4 is a structural schematic diagram of the upper lid without a limiting lock plate of the present invention.
Figure 5:
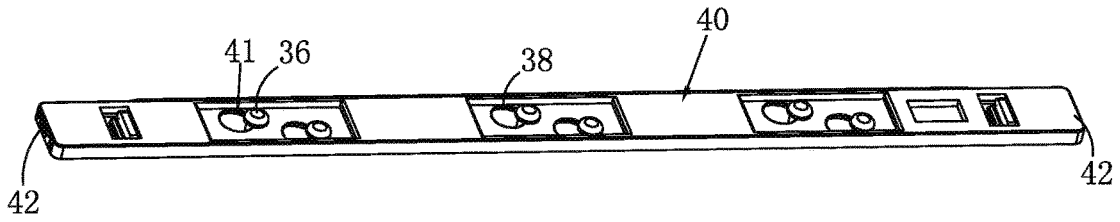
FIG. 5 is a structural schematic diagram during limited locking of the limiting lock plate and the limiting buckle portion of the present invention.
Figure 6:
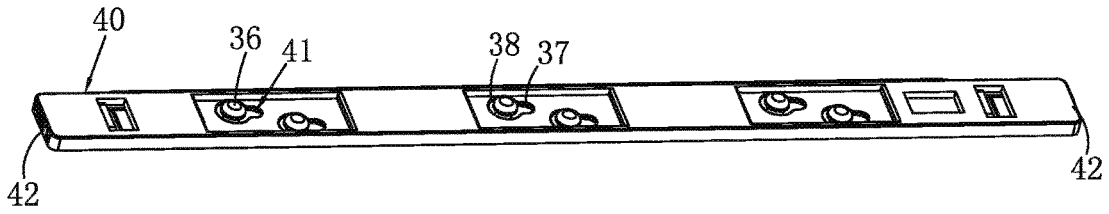
FIG. 6 is a structural schematic diagram when releasing limited locking of the limiting lock plate and the limiting buckle portion of the present invention.
Figure 7:
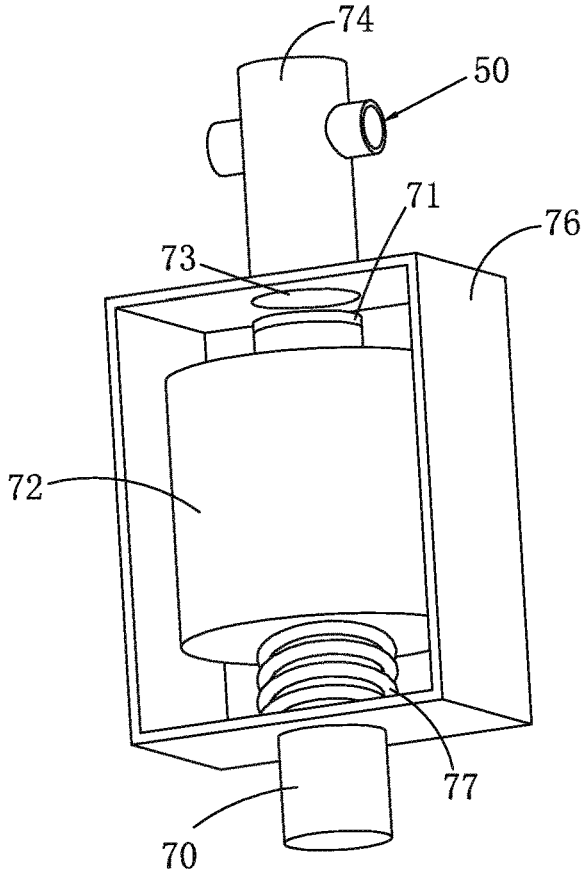
FIG. 7 is a structural schematic diagram of an air valve device of the present invention.
Figure 8:
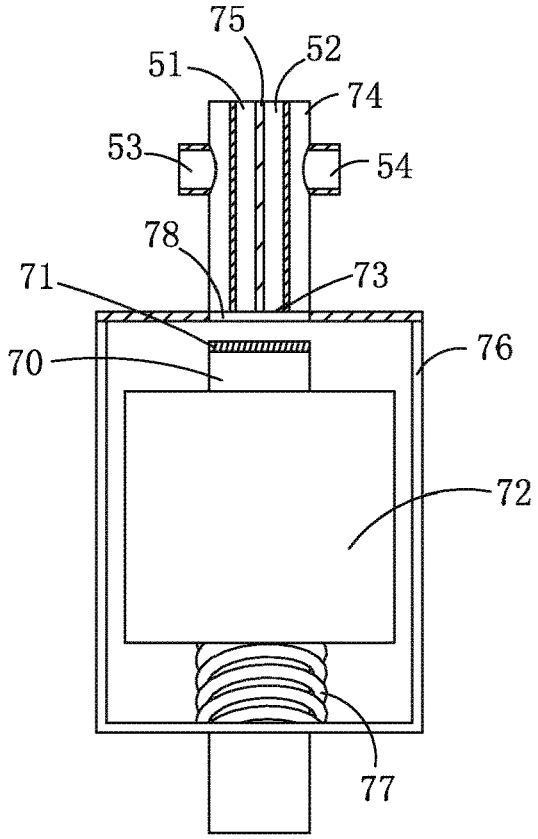
FIG. 8 is a structural schematic diagram of a local section of an air valve device when a rear end surface of a pressure relief valve housing is installed on a front side of a front panel and a sealing piece is located at a chamber communication position of the present invention.
Figure 9:
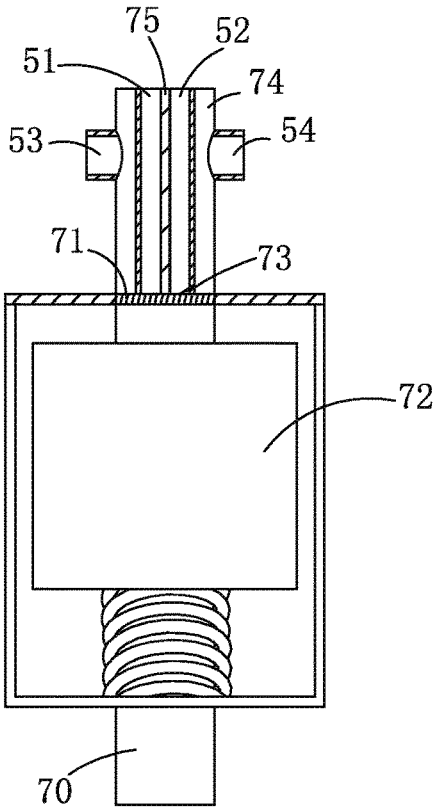
FIG. 9 is a structural schematic diagram of a local section of an air valve device when a rear end surface of a pressure relief valve housing is installed on a front side of a front panel and a sealing piece is located at a closed position of the present invention.
Figure 10:
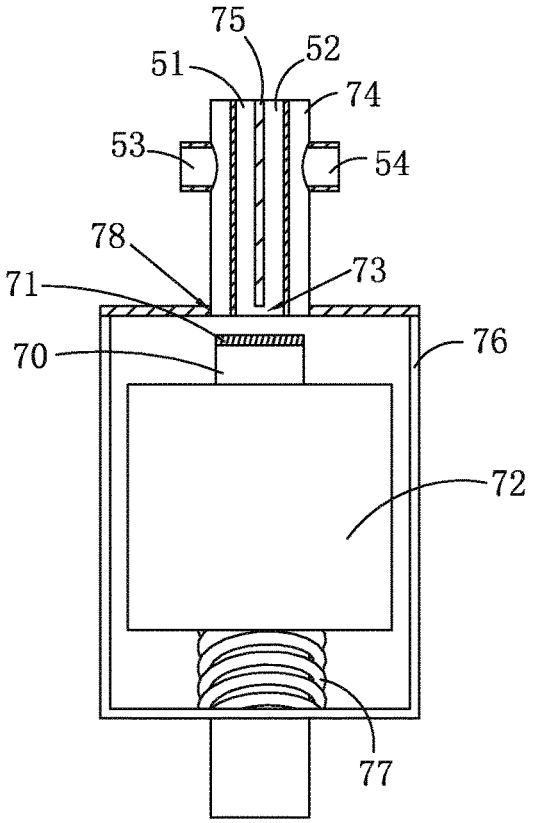
FIG. 10 is a structural schematic diagram of a local section of an air valve device when a rear end surface of a pressure relief valve housing is installed in a bracket through hole and a sealing piece is located at a chamber communication position of the present invention.
Figure 11:
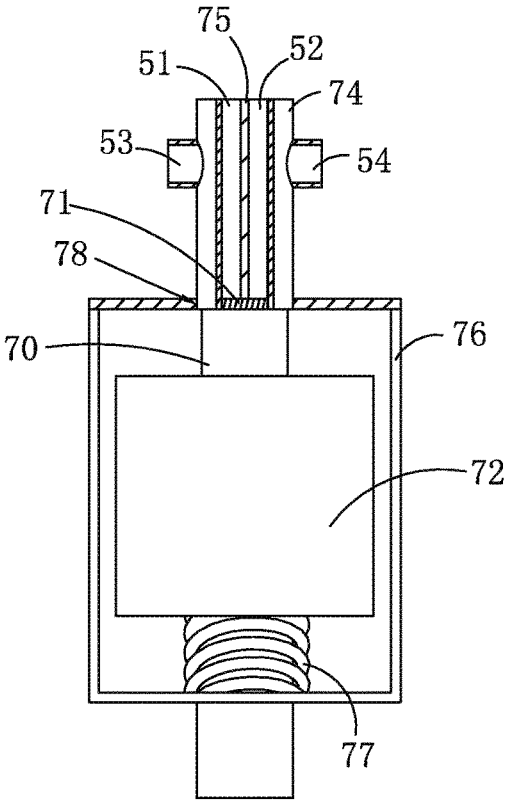
FIG. 11 is a structural schematic diagram of a local section of an air valve device when a rear end surface of a pressure relief valve housing is installed in a bracket through hole and a sealing piece is located at a closed position of the present invention.
Figure 12:
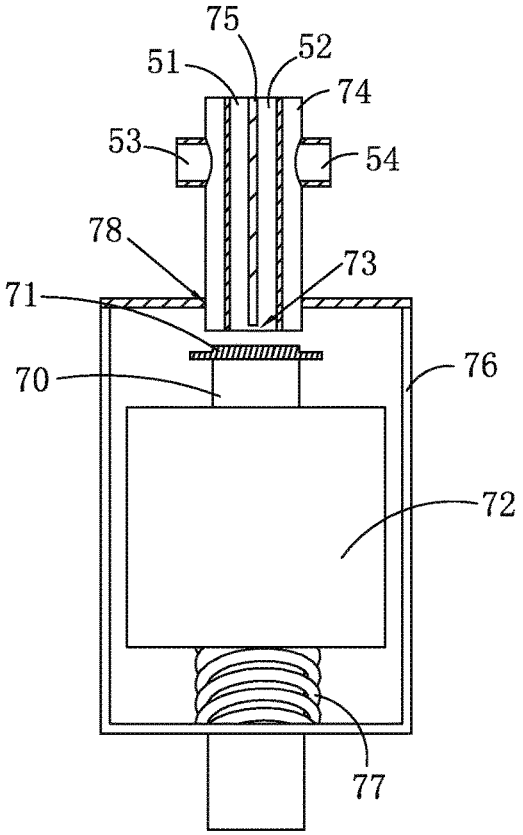
FIG. 12 is a structural schematic diagram of a local section of an air valve device when a rear end surface of a pressure relief valve housing is protruded and installed on a rear side of a front panel and a sealing piece is located at a chamber communication position of the present invention.
Figure 13:
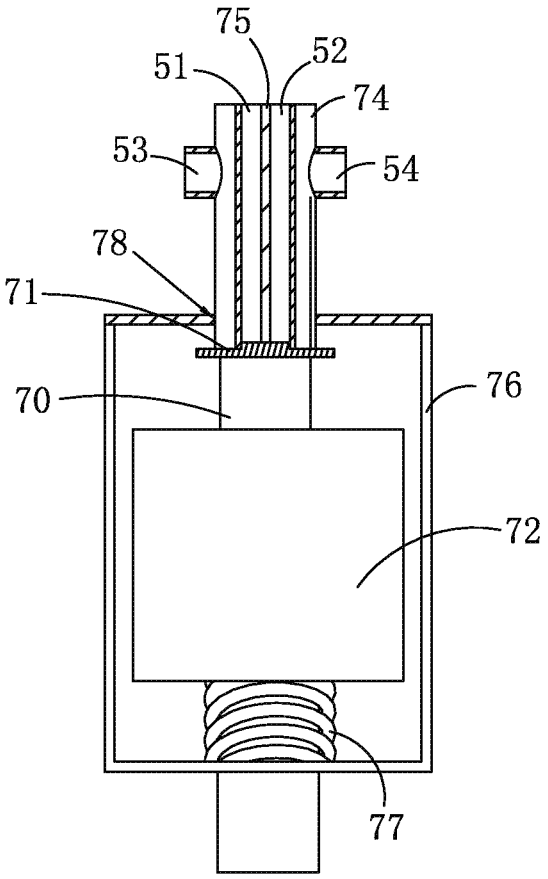
FIG. 13 is a structural schematic diagram of a local section of an air valve device when a rear end surface of a pressure relief valve housing is protruded and installed on a rear side of a front panel and a sealing piece is located at a closed position of the present invention.

The second setting method of the pressure relief valve housing 74 is specifically, the rear end portion of the pressure relief valve housing 74 is fixed in the bracket through hole 78, and the rear end surface of the pressure relief valve housing 74 is located on one side of the front panel or in the bracket through hole 78. More specifically, the rear end surface of the pressure relief valve housing 74 is connected to the front panel of the bracket 76. As shown in FIG. 2 to FIG. 3, the rear end of the sealing hole portion 73 is located at the front end of the bracket through hole 78; alternatively, as shown in FIG. 4 and FIG. 5, the pressure relief valve housing 74 is inserted into the bracket through hole 78, the rear end surface of the pressure relief valve housing 74 is located in the bracket through hole 78, and the outer contour of the pressure relief valve housing 74 is matched and connected with the bracket through hole 78. The outer shape of the sealing piece 71 matches the shape of the inner wall of the sealing hole portion 73. When the sealing piece 71 is sealingly fitted with the sealing hole portion 73, the sealing piece 71 is inserted into the sealing hole portion 73 through the bracket through hole 78, the side surface of the sealing piece 71 abuts against the inner wall of the sealing hole portion 73, and the side surface of the sealing piece 71 is sealingly fitted with the inner wall of the sealing hole portion 73. The sealing piece 71 is inserted into the bracket through hole 78 and abuts the partition plate toward the rear end surface of the sealing hole portion 73. Alternatively, the sealing piece 71 is inserted into the sealing hole portion 73 through the bracket through hole 78 and abuts the partition plate toward the rear end surface of the sealing hole portion 73, and the sealing piece 71 seals each pressure relief chamber; as shown in FIG. 6 to FIG. 7, a front panel is provided at the front end of the bracket 76, the middle of the front panel is provided with a bracket through hole 78, the rear end portion of the pressure relief valve housing 74 is fixed to the bracket through hole 78, the rear end surface of the pressure relief valve housing 74 protrudes from the rear side of the front panel, and the sealing piece 71 is sealingly fitted with the sealing hole portion 73. A sealing surface is provided on a side of the sealing piece 71 facing the pressure relief valve housing 74. The sealing surface is larger than the transverse section of the sealing hole portion 73. When the sealing piece 71 is sealingly fitted with the sealing hole portion 73, the sealing surface abuts against and blocks the bracket through hole 78 or the sealing hole portion 73. The sealing surface abuts the sealing hole portion 73 and abuts the partition 75 toward the rear end surface of the sealing hole portion 73; alternatively, the sealing piece 71 is inserted into the sealing hole portion 73 and abuts the partition 75 toward the rear end surface of the sealing hole portion 73, and the sealing piece 71 seals each of the pressure relief chambers, respectively. More specifically, as shown in FIG. 4 to FIG. 5, a vacuum packaging machine comprises a lower seat 20 and an upper lid 10, and the upper lid 10 is hinged to the lower seat 20; a vacuum sealing machine comprises an evacuation tank and a lid-locking mechanism; a vacuum pumping device comprises a first vacuum pump and a second vacuum pump; and a vacuum working chamber comprises an evacuation chamber and a lid-locking chamber, the evacuation chamber is located in the evacuation tank, the lid-locking chamber is located in the lid-locking mechanism, the first vacuum pump is connected to the evacuation chamber, and the second vacuum pump is connected to the lid-locking chamber. One partition 75 is formed or fixed in the inner chamber of the pressure relief valve housing 74, the inner chamber of the pressure relief valve housing 74 is partitioned by the partition 75 to form an evacuation tank pressure relief chamber 51 and a lid-locking pressure relief chamber 52; and the evacuation tank pressure relief chamber 51 and the lid-locking pressure relief chamber 52 are respectively located on both sides of the partition 75. The partition 75 divides the pressure relief chamber into an evacuation tank pressure relief chamber 51 and a lid-locking pressure relief chamber 52 to connect the air valve device to the evacuation tank and the functional mechanism respectively at the same time, so that the evacuation sealed chamber and the functional sealed chamber are two independent sealed chambers. The pressure relief interface 50 provided on the chamber wall of the evacuation tank pressure relief chamber 51 is an evacuation tank connection port 53, and the outer end of the evacuation tank connection port 53 is connected to the evacuation chamber; the pressure relief interface 50 provided on the chamber wall of the lid-locking pressure relief chamber 52 is a lid-locking connection port 54, and the outer end of the lid-locking connection port 54 is connected to the lid-locking chamber.

When the second vacuum pump or the first vacuum pump is started, the sealing piece 71 is in the closed position, the sealing piece 71 is sealingly fitted with the sealing hole portion 73, the evacuation tank pressure relief chamber 51 and the lid-locking pressure relief chamber 52 are separated from each other, the evacuation tank pressure relief chamber 51 and the evacuation chamber form a sealed evacuation working chamber, which is prepared for the first vacuum pump to evacuate the evacuation tank; the lid-locking pressure relief chamber 52 and the lid-locking chamber form a sealed lid-locking vacuum working chamber, which is prepared for the second vacuum pump to evacuate the lid-locking chamber; when the second vacuum pump and the first vacuum pump are stopped, the sealing piece 71 is in the chamber communication position, the sealing piece 71 is separated from the sealing hole portion 73, and the evacuation working chamber and the lid-locking vacuum working chamber are respectively communicated with the atmospheric pressure. The evacuation working chamber and the lid-locking vacuum working chamber are respectively restored from the negative pressure state to the atmospheric pressure state.

The lid-locking mechanism is installed on the lower seat 20, comprising a lifting plate 32, a concave chamber 31, and a second vacuum pump. The lifting plate 32 slides up and down on the top surface of the lower seat 20, the top surface of the lifting plate 32 is provided with a limiting buckle portion 36, the limiting buckle portion 36 is buckled with the upper lid 10, the second vacuum pump is drivingly connected to the lifting plate 32, the lower seat 20 is recessed downward to form a concave chamber 31, the position of the concave chamber 31 corresponds to the position of the lifting plate 32, the lifting plate 32 is connected to the concave chamber 31 to form a lid-locking chamber, an elastic portion 34 is provided in the lid-locking chamber, the elastic portion 34 abuts the top surface and the bottom surface of the lid-locking chamber, the second vacuum pump is connected to the lid-locking chamber, and the lid-locking connection port 54 is connected to the lid-locking chamber. The lid-locking mechanism realizes the lid-locking function by changing the air pressure in the lid-locking chamber. Specifically, when the sealing piece 71 is in the closed position, the lid-locking pressure relief chamber 52 and the lid-locking chamber form a sealed lid-locking vacuum working chamber, the second vacuum pump is started, a negative pressure is formed in the lid-locking vacuum working chamber, the lifting plate 32 presses the elastic portion 34 in the lid-locking vacuum working chamber under the action of the negative pressure, and the lifting plate 32, the limiting buckle portion 36 and the upper lid 10 move downward; the second vacuum pump is stopped, the sealing piece 71 is located in the chamber communication position, the lid-locking pressure relief chamber 52 communicates with the atmospheric pressure, the lid-locking vacuum working chamber is restored from the negative pressure state to the atmospheric pressure state, and the lifting plate 32, the limiting buckle portion 36 and the upper lid 10 move upward under the action of the atmospheric pressure. The sealing piece 71 is connected to or separated from the sealing hole portion 73 by an iron core driving device 72 driving an iron core 70 to slide.

The above contents are only preferred examples of the present invention, and those skilled in the art will have changes in the specific embodiment and application scope according to the idea of the present invention. The contents of the present description shall not be construed as the limitation of the present invention.

The invention claimed is:

1. A vacuum sealing machine capable of locking cover automatically having upper cover limiting mechanism comprising an upper lid, a lower seat, and an evacuation tank, the upper lid is hinged to the lower seat the evacuation tank is located at the front of the vacuum sealing machine, wherein the vacuum machine comprises a lid-locking mechanism and an upper lid-limiting mechanism the lid-locking mechanism is installed on the upper lid or the lower seat, and is connected to the upper lid-limiting mechanism the upper lid-limiting mechanism comprises a limiting lock plate and a limiting buckle portion, the limiting lock plate movably installed on the upper lid is fitted with the buckle of the limiting buckle portion installed on the lower seat; alternatively, the limiting lock plate movably installed on the lower seat is fitted with the buckle of the limiting buckle portion installed on the upper lid after the limiting lock plate is fitted with the buckle of the limiting buckle portion, a bag-in gap with a set height is set between the limiting lock plate and the limiting buckle portion;

wherein the lid-locking mechanism comprises a lifting plate, the lifting plate slides up and down on the top surface of the lower seat, the top surface of the lifting plate is provided with the limiting buckle portion;

wherein the upper lid has an open position, a limited bag-in position and a locking position, when the upper lid is in an open position, the limiting lock plate is separated from the limiting buckle portion, and the upper lid is in an open state with respect to the lower seat;

when the upper lid is in a limited bag-in position, the limiting lock plate is fitted with the buckle of the limiting buckle portion, and the bag-in gap with a set height is maintained between the upper lid and the lower seat for inserting a vacuum packaging bag; and when the upper lid is in a locking position, the upper lid presses the lower seat;

wherein the limiting lock plate is slidably installed on the upper lid, and the limiting buckle portion is fixedly installed on the lower seat the middle of the upper lid is provided with a sliding slot, the position of the sliding slot corresponds to the position of the lid-locking mechanism, the limiting lock plate is slidably installed in the sliding slot, the limiting buckle portion is a buckle post with a set height installed in the lower seat, the middle of the limiting lock plate is provided with a buckle through slot, and the buckle post is fitted with the buckle of the buckle through slot.

2. The vacuum sealing machine according to claim 1, wherein the vacuum sealing machine comprises a vacuum pumping device, the lower seat is provided with a lower evacuation tank, the vacuum pumping device is connected to the lower evacuation tank, the lower seat is provided with a bag-feeding platform, the bag-feeding platform extends from the lower evacuation tank to the front end of the lower seat, a flexible seal ring is installed on the bottom surface of the upper lid, the flexible seal ring protrudes from the bottom surface of the upper lid, the flexible seal ring presses the bag-feeding platform of the lower seat is locked with the lower seat, and the flexible seal ring surrounds and encloses the lower evacuation tank.

3. The vacuum sealing machine according to claim 2, wherein the upper lid is in the open position, the flexible seal ring is far from the lower seat; when the upper lid is in the limited bag-in position, the flexible seal ring is separated from the lower seat; and when the upper lid is in the locking position, the flexible seal ring abuts the lower seat.

4. The vacuum sealing machine according to claim 2, wherein the lower evacuation tank is provided with an upper evacuation tank at a position corresponding to the upper lid, at least one baffle plate protrudes upward from the rear edge of the lower evacuation tank, and the baffle plate is inserted into the upper evacuation tank when the upper lid and the lower seat are closed;

the front end of the lower seat is provided with a bag inlet, the position of the bag inlet is adapted to the bag-feeding platform, and the bag inlet is located at the upper part of the bag-feeding platform;

the bag-feeding platform extends outward from the front end of the lower seat to project outward to form a supporting portion; and the flexible seal ring has an upper fixing portion and an annular wall body, the upper fixing portion is installed on the bottom surface of the upper lid, the annular wall body is installed on the upper fixing portion, and the annular wall body projects downward from the upper lid.

5. The vacuum sealing machine according to claim 1, wherein the lid-locking mechanism comprises a concave chamber, the lower seat is recessed downward to form a concave chamber, the position of the concave chamber corresponds to the position of the lifting plate, the lifting plate is connected to the concave chamber to form a sealed chamber, an elastic portion is provided in the sealed chamber, the elastic portion abuts the top surface and the bottom surface of the sealed chamber.

6. The vacuum sealing machine according to claim 5, wherein the vacuum sealing machine comprises a vacuum pumping device and at least two vacuum working chambers, the vacuum pumping device is connected to each vacuum working chamber, respectively, and the vacuum sealing machine comprises an air valve device, comprising a solenoid and a pressure relief valve housing, the solenoid is provided with a bracket and an iron core, and the iron core is slidably installed on the bracket;

the pressure relief valve housing is installed on the bracket, at least two pressure relief interfaces are provided on the first side of the pressure relief valve housing, and the sealing hole portion is provided on the second side;

at least one partition is installed in the inner chamber of the pressure relief valve housing, the inner chamber of the pressure relief valve housing is partitioned by the partition to form at least two pressure relief chambers, each of which is connected to the inner end of a corresponding pressure relief interface, respectively;

a first end portion of the iron core faces the sealing hole portion, a sealing piece is fixed at the first end portion of the iron core, and the sealing piece is sealingly fitted with the sealing hole portion; and the outer end of each pressure relief interface communicates with a corresponding vacuum working chamber, respectively.

7. The vacuum sealing machine according to claim 6, wherein each of the pressure relief chambers communicates with the sealing hole portion, and each pressure relief chamber is provided with at least one pressure relief interface; when the sealing piece moves toward the pressure relief valve housing and the sealing piece abuts against the sealing hole portion or the bracket, the sealing piece is sealingly fitted with the sealing hole portion;

the sealing piece has a closed position and a chamber communication position;

when the sealing piece is in the closed position, the sealing piece is sealingly fitted with the sealing hole portion, the sealing piece is respectively sealingly fitted with each pressure relief chamber, and each pressure relief chamber is connected with the corresponding vacuum working chamber to form each sealed vacuum working chamber; and when the sealing piece is in the chamber communication position, the sealing piece is separated from the sealing hole portion, the sealing piece is sealingly fitted with each pressure relief chamber, respectively, the sealing hole portion is connected to the atmospheric pressure, and each pressure relief chamber and the corresponding vacuum working chamber are connected to the atmospheric pressure.

8. The vacuum sealing machine according to claim 7, wherein the vacuum pumping device comprises a first vacuum pump and a second vacuum pump, the second vacuum pump is a driving device, the vacuum working chamber comprises an evacuation chamber and a lid-locking chamber, the evacuation chamber is located in the evacuation tank, the lid-locking chamber is located in the lid-locking mechanism, the first vacuum pump is connected to the evacuation chamber, and the second vacuum pump is connected to the lid-locking chamber;

one partition is formed or fixed in the inner chamber of the pressure relief valve housing, the inner chamber of the pressure relief valve housing is partitioned by the partition to form an evacuation tank pressure relief chamber and a lid-locking pressure relief chamber;

the pressure relief interface provided on the chamber wall of the evacuation tank pressure relief chamber is an evacuation tank connection port, and the outer end of the evacuation tank connection port is connected to the evacuation chamber; the pressure relief interface provided on the chamber wall of the lid-locking pressure relief chamber is a lid-locking connection port, and the outer end of the lid-locking connection port is connected to the lid-locking chamber;

when the second vacuum pump or the first vacuum pump is started, the sealing piece is in the closed position, the sealing piece is sealingly fitted with the sealing hole portion, the evacuation tank pressure relief chamber and the lid-locking pressure relief chamber are separated from each other, the evacuation tank pressure relief chamber and the evacuation chamber form a sealed evacuation working chamber, and the lid-locking pressure relief chamber and the lid-locking chamber form a sealed lid-locking vacuum working chamber; and when the first vacuum pump and the second vacuum pump are stopped, the sealing piece is in the chamber communication position, the sealing piece is separated from the sealing hole portion, and the evacuation working chamber and the lid-locking vacuum working chamber are respectively communicated with the atmospheric pressure.

9. The vacuum sealing machine according to claim 8, wherein the solenoid comprises an iron core driving device, the iron core driving device is located in the bracket, the iron core driving device comprises at least one winding group, the winding group is fixed to the middle and rear part of the iron core, and the winding group is wrapped around the outer edge of the middle and rear part of the iron core;

the solenoid is provided with an iron core return spring, the iron core return spring is sleeved on the iron core, one end of the iron core return spring is connected to the iron core, and the other end abuts against or is connected to the bracket;

the rear end portion of the pressure relief valve housing is fixed to the front end portion of the bracket, the front end surface of the pressure relief valve housing is a closed surface, each of the pressure relief interfaces is respectively provided on a side of the pressure relief valve housing, and the rear end surface of the pressure relief valve housing is provided with the sealing hole portion;

the front end of the bracket is provided with a front panel, the middle of the front panel is provided with a bracket through hole, and the rear end portion of the pressure relief valve housing is fixed to the bracket;

the sealing hole portion communicates with the bracket through hole, and the sealing piece is sealingly fitted with the bracket through hole or the sealing piece is sealingly fitted with the sealing hole portion, alternatively, the rear end surface of the pressure relief valve housing protrudes from the rear side of the front panel, and the sealing piece is sealingly fitted with the sealing hole portion.

10. The vacuum sealing machine according to claim 1, wherein the buckle through slot comprises a clamping portion and a separating portion, when the clamping portion moves to the buckle post, the limiting buckle portion is fitted with the buckle of the limiting lock plate; when the separating portion moves to the buckle post, the limiting buckle portion is separated from the limiting lock plate.

11. The vacuum sealing machine according to claim 1, wherein each side of the upper lid is provided with a push port, the left and right ends of the limiting lock plate are respectively provided with a hand pressing portion, and at least one hand pressing portion passes through the push port and is exposed outside the upper lid.

12. The vacuum sealing machine according to claim 1, wherein the limiting lock plate is fixedly installed, slidably installed or rotationally installed on the upper lid, and the limiting buckle portion is fixedly installed, slidably installed or rotationally installed on the lower seat; when the upper lid is rotated relative to the lower seat to the limited bag-in position or a position adjacent to the limited bag-in position, the limiting lock plate is fitted with the buckle of the limiting buckle portion, the upper lid is limited by the upper lid-limiting mechanism and kept at the limited bag-in position, and the height of the bag-in gap is greater than the total thickness of the vacuum packaging bag and less than 1 cm.

13. The vacuum sealing machine according to claim 12, wherein the height of the front side of the bag-in gap is controlled at 1 to 5 mm, and the height of the middle and rear sides of the bag-in gap is controlled at 1 to 3 mm.

14. The vacuum sealing machine according to claim 1, wherein when the upper lid rotates toward the lower seat and reaches the limited bag-in position, the automatic plate pushing mechanism pushes the limiting lock plate, and the limiting lock plate is fitted with the buckle of the limiting buckle portion; and the automatic plate pushing mechanism uses a mechanical transmission mechanism driven by a spring, an electromagnet or a motor.

* * * * *